US005168613A

United States Patent [19]

Bair et al.

[11] Patent Number: 5,168,613

[45] Date of Patent: Dec. 8, 1992

[54] CONTROLLABLE DOOR FOR DEFECTIVE LEAD REMOVAL

[75] Inventors: William H. Bair, Marysville; David J. Erb, Harrisburg; Alden O. Long, Carlisle, all of Pa.

[73] Assignee: AMP Incorporated, Harrisburg, Pa.

[21] Appl. No.: 763,004

[22] Filed: Sep. 20, 1991

[51] Int. Cl.[5] ..... H01R 43/00

[52] U.S. Cl. ..... 29/33 M; 29/564.4; 29/753

[58] Field of Search ..... 29/564.6, 566.3, 749, 29/753, 747, 564.4; 198/351, 362

[56] References Cited

U.S. PATENT DOCUMENTS 4,087,908 5/1978 Fusco et al. ..... 29/753
4,561,155 12/1985 Randar et al. ..... 29/33 M
4,584,757 4/1986 Adlon et al. ..... 29/564.4
4,641,428 2/1987 Anderson ..... 29/564.4
4,825,537 5/1989 Berry et al. ..... 29/753
5,083,370 1/1992 Koch et al. ..... 29/753

*Primary Examiner*—William Briggs

[57] ABSTRACT

The present invention includes a lead sorting module in an automated lead making machine for segregating leads having defective terminations from the other leads. The module includes a lead deflecting door that is moved by an actuator to cause the leads having defective terminations to fall into one tray and the other leads to fall into another tray. The machine includes a crimp quality monitor which determines whether or not a termination is defective and then effects a corresponding control over the actuator.

10 Claims, 7 Drawing Sheets

CONTROLLABLE DOOR FOR DEFECTIVE LEAD REMOVAL

The present invention relates to automated machines for making electrical leads of the type having a terminal attached to one or both ends.

The present application is related to copending U.S. patent application Ser. No. 07/708,408 which was filed May 30, 1991 and is assigned to the present assignee.

BACKGROUND OF THE INVENTION

A widely used type of lead making machine, referred to as an in-line machine, comprises a wire feeding means for feeding wire along a horizontal straight feed path which extends through upstream (relative to the direction of wire feed) and downstream transfer mechanisms and through wire severing blades and insulation cutting blades which are located between the upstream and downstream wire transferring mechanisms. Crimping presses are located adjacent to the wire severing and insulation cutting blades on one side or on both sides of the feed path. In use, the wire is fed through the transferring mechanisms until the desired length for the lead extends from the severing blades beyond the downstream transferring mechanism. The wire severing and insulation cutting blades are then closed and the transferring mechanisms are moved axially away from the blades to strip insulation from the cut ends of the wire, which extends from the wire source, and the trailing end of the lead which extends through the downstream transferring mechanism. The transferring mechanisms are then shifted to present the stripped ends of the wire and lead to the crimping presses at which terminals are crimped onto the stripped ends. The transferring mechanisms are then returned to their aligned positions on the feed path. A completed lead is removed from the downstream transferring mechanism while the wire from the endless source extends from the upstream mechanism and has a terminal crimped onto its end. The process of feeding the wire, closing the cutting and severing blades, etc., is then repeated to produce the next lead in the series. Such a machine is more fully described in copending U.S. patent application Ser. No. 576,309 which was filed Aug. 31, 1990, and is incorporated by reference as though set forth verbatim herein. Crimping presses, similar to the type used in the lead making machine described above, can be fitted with monitoring equipment for determining the quality of each crimped connection made and identifying those leads having defective terminal attachments Such an equipped press is disclosed in copending U.S. patent application Ser. No. 529,036 which was filed May 29, 1990 and is incorporated by reference as though set forth verbatim herein. The equipment includes a computer and associated devices for sensing force and ram position so that a work curve can be generated for each crimping operation as the crimped connection is being made. This work curve is then analyzed to determine the quality of the crimped connection with respect to some previously defined standard. However, such an equipped press has not heretofore been coupled to a lead making machine of the type described above to identify those leads having defective terminal attachments and to automatically separate them from leads of acceptable quality during operation of the machine. The present invention addresses such a machine.

SUMMARY OF THE INVENTION

The present invention permits the identifying and segregation of defective leads during the operation of an automated lead making machine. The machine includes means for cutting a lead of desired length from a supply of wire and for preparing the ends of the lead, press means for attaching a terminal to an end of the lead, and monitor means for determining the quality of attachment of the terminal and for identifying a defective attachment. A lead transport means is provided having a frame and a gripper movable with respect to the frame for gripping the lead at a pick-up station and moving it to an exit station and thereupon releasing the lead to fall by gravity along a path in a downward direction within the exit station. A lead sorting module is disposed within the exit station and has first and second compartments. A deflecting member is provided that is movable to a first position where it intersects the wire path and a second position away from the first position. An actuator means is provided that, in response to the monitor means, moves the deflecting member to one of the two positions when a defective attachment is identified so that when the lead is falling along the path the lead enters into the first compartment.

DESCRIPTION OF THE PREFERRED EMBODIMENT

Figure 3:
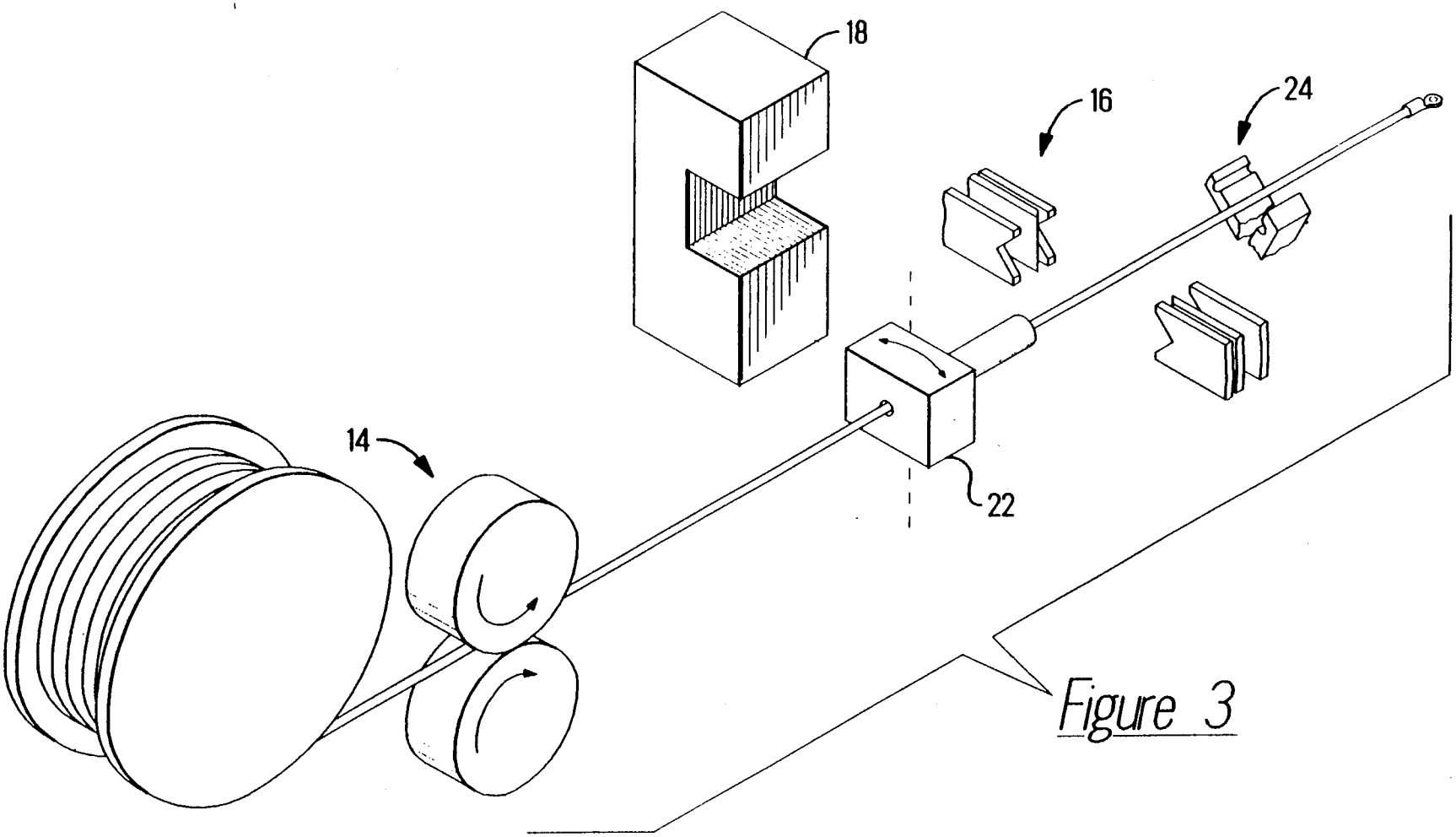
Figure 4:
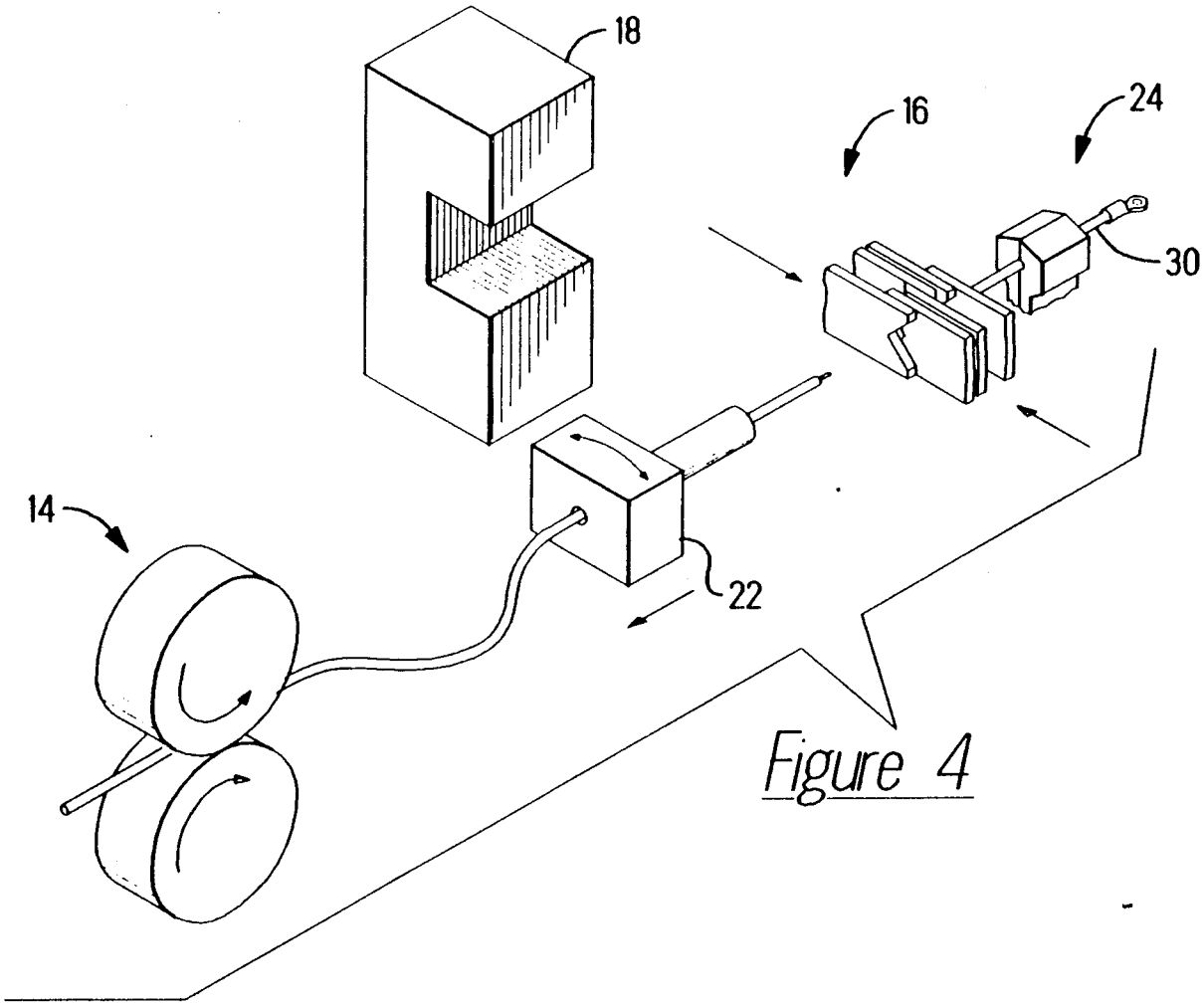

There is shown in FIGS. 1, 2, 3 and 4 an automated lead making machine 10 having a top plate 12, a wire feeding apparatus 14, a wire severing and insulation stripping assembly 16, and a pair of crimping presses 18 and 20, or similar terminal applicators. A wire transfer mechanism 22 receives the wire from the wire feeding apparatus 14, presents the first end, which has been cut and stripped when the previously processed lead was cut, to the press 18 for application of a terminal. The wire transfer mechanism 22 is then brought back into alignment with the severing and stripping assembly 16 and the wire fed to the desired lead length as best seen in FIG. 3. The portion of the wire fed past the severing and stripping assembly 16 is then clamped by a second wire transfer mechanism 24 while the severing and stripping assembly 16 is actuated to cut a lead 30 to length and strip the insulation from the second end of the lead and from the first end of the wire being held by the transfer mechanism 22 as shown in FIG. 4. The wire transfer mechanism 24 then swings counterclockwise to present the second end of the lead 30 to the press 20 for application of a terminal as shown in phantom line in FIG. 1. After the terminal is applied, a wire transport means 32 grips the lead 30 near its second end, the second transfer mechanism 24 releasing the wire, and swings clockwise from a first position shown in phantom lines to a second position shown in solid lines in FIG. 1. The lead is then dropped into a lead stacking tray 34 for later removal by an operator. The control of the machine is effected by a computer. While the above is a very brief description of the major components of an automated lead making machine and its operation, a more detailed description is presented in the above mentioned '309 patent application.

Figure 1:
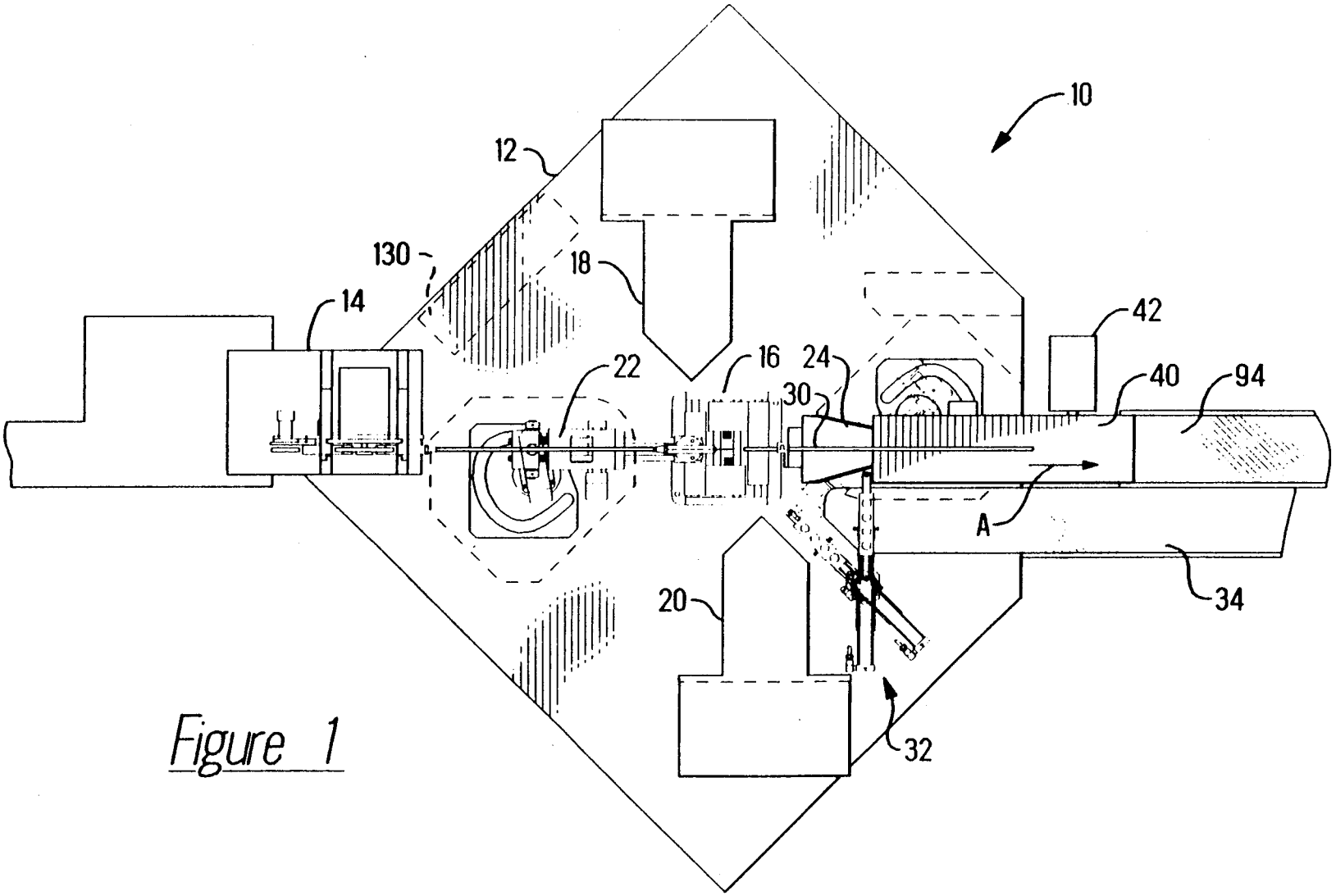
FIG. 1 is a plan view of an automated lead making machine incorporating the teachings of the present invention.
Figure 2:
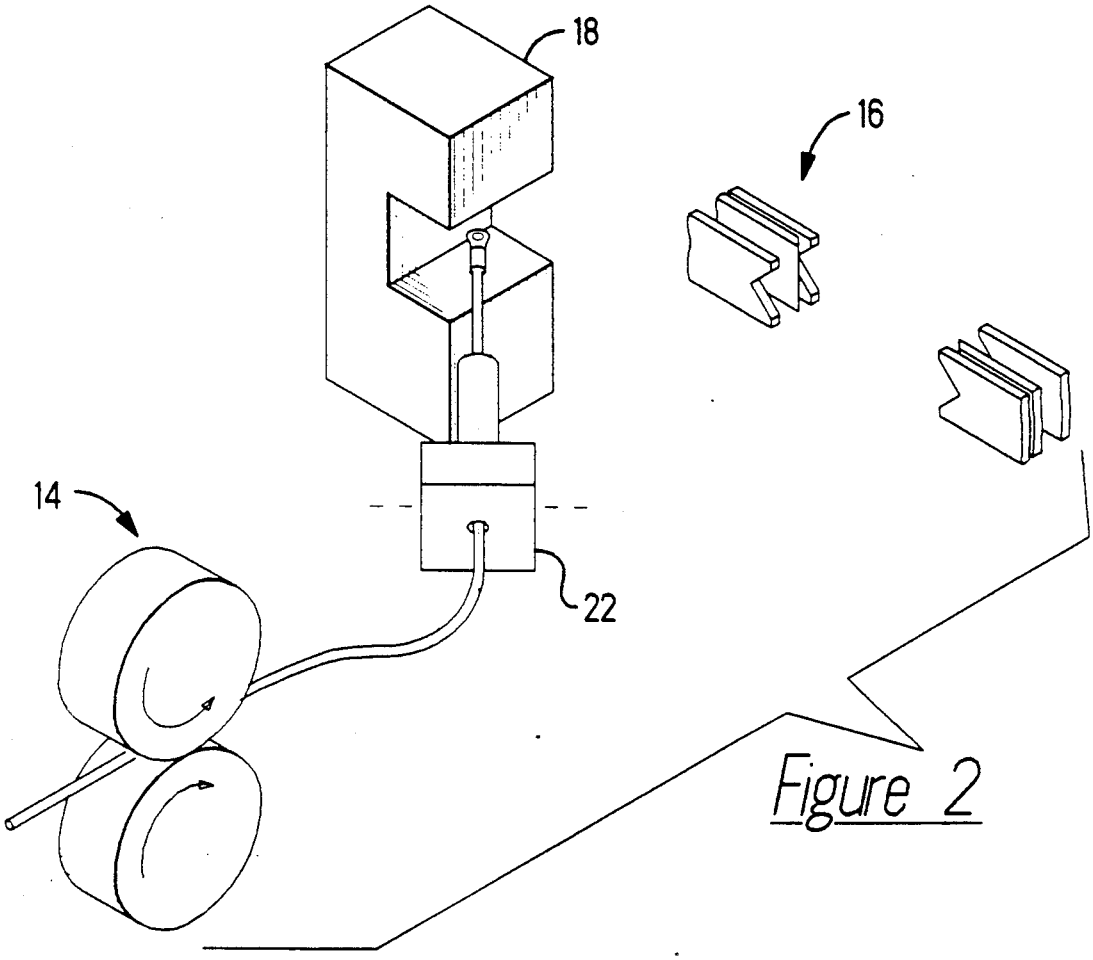
FIGS. 2, 3 and 4 are schematic diagrams depicting the operation of the machine.
Figure 6:
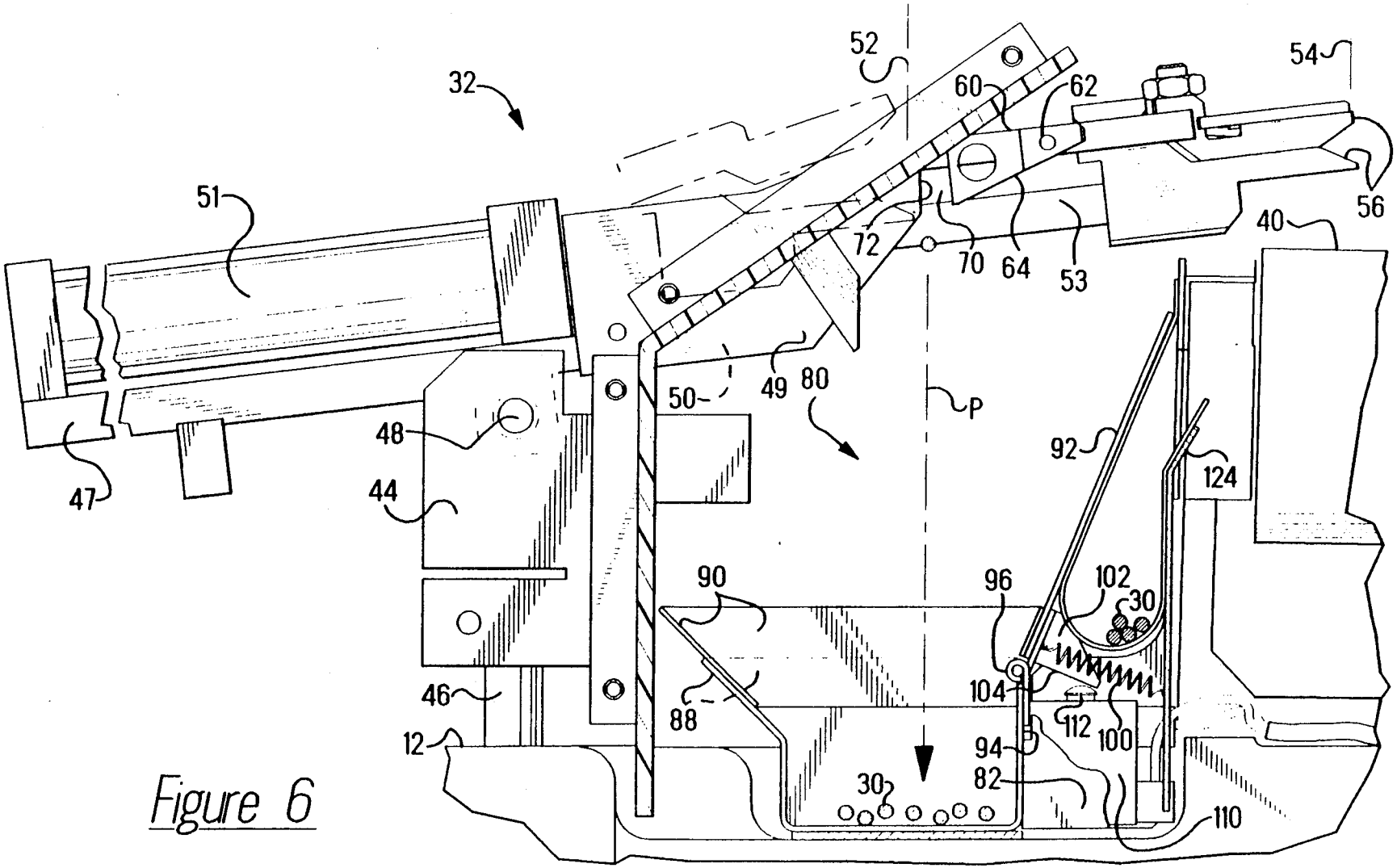
FIGS. 6 and 7 are front views of the lead sorting module showing the deflecting member in its two possible positions.
Figure 7:
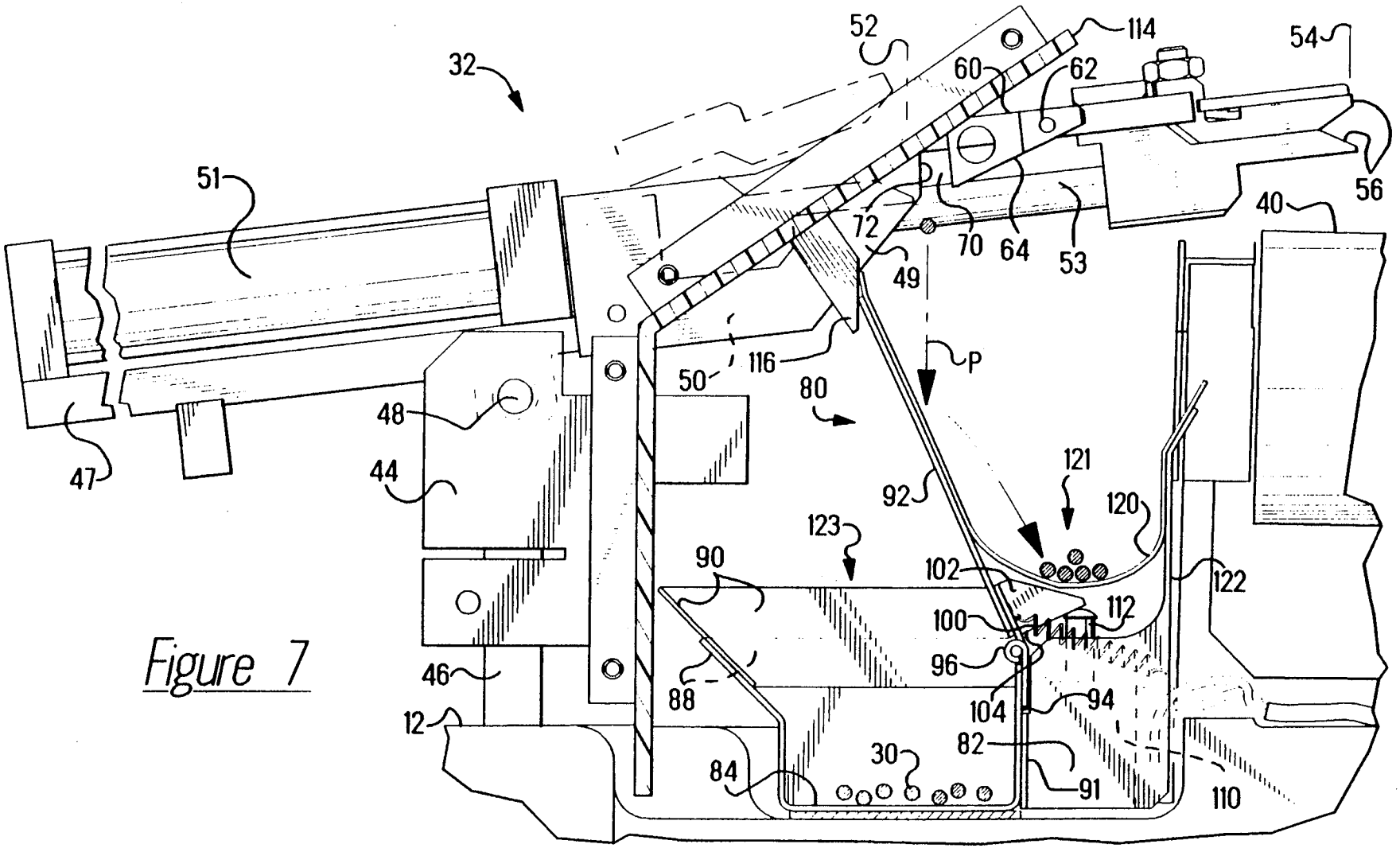

A belt conveyor 40 is driven by a motor 42 so that the belt moves in a direction indicated by the arrow A in FIG. 1. This belt conveyor 40 has two purposes as will be described below. FIGS. 6 and 7 show details of the wire transport means 32 having a mounting bracket or frame 44 pivotally mounted to the top plate 12 by means of the shaft 46. The shaft 46 permits pivotal motion of the transport means 32 back and forth between its first and second positions. A pivot plate 47 is pivotally attached to the bracket 44 by means of the pin 48 which is arranged normal to the shaft 46. A pair of side members 49 and 50 are attached to and pivot with the plate 47. An air cylinder 51 having a piston rod 53 is mounted to the plate 47 as shown in FIGS. 6 and 7. A pair of wire gripping jaws 56 are mounted to the end of the piston rod 53 as shown. The piston rod 53 is arranged to move the gripping jaws 56 from a retracted position at an exit station shown in phantom lines at 52 in FIG. 6 to an extended position at a pick-up station shown in solid lines at 54. When the gripper jaws 56 are moved to their retracted position camming surfaces associated with the side members 49 and 50 are engaged by the jaws 56 causing the jaws to open as shown in phantom lines in FIG. 6. A latch 60 is pivotally mounted to the side members 49 and 50 at the point 62 as shown in FIGS. 6 and 7. A torsion spring, not shown, is arranged to urge the latch counterclockwise to the position shown. An angled camming surface 64 is disposed on the underside of the latch 60 which crosses the wire path so that, as the gripper jaws 56 move the lead 30 toward the retracted position at 52, the lead 30 engages this surface 64 causing the latch to pivot clockwise. As the lead 30 passes, the latch is returned to its position shown in FIG. 6 with the lead trapped in a channel 70 formed by the latch 60 and wire abutting surfaces 72 on the side members 49 and 50. As the gripper jaws 56 continue to move toward the retracted position, the lead 30 abuts the surface 72 and is held there until the gripper jaws 56 have completely retracted to the position shown at 52 in FIG. 6. Due to the dynamic characteristics of a laterally moving wire being suddenly stopped against the abutting surface 72, the wire tends to rebound unpredictably. The purpose of the latch 60 is to create the channel 70 which confines and controls this rebound movement and acts as a dampener means allowing the lead 30 to be ejected and to fall by gravity substantially straight down along a wire path P within the exit station. It will be understood by those skilled in the art that the lead 30 may be ejected by means of a powered mechanism such as a spring or air cylinder and thereby cause the lead to move along the wire path P independent of gravity.

Figure 5:
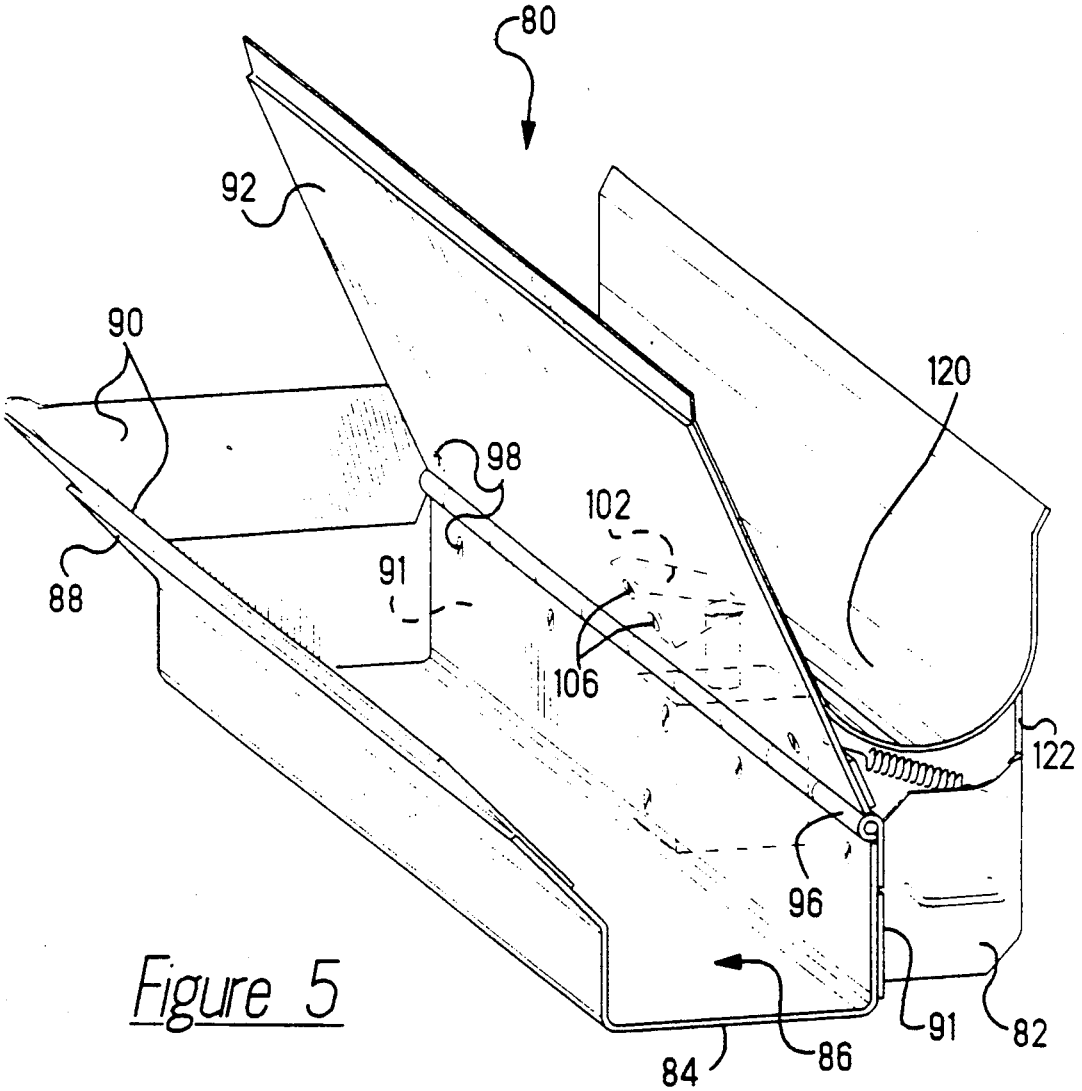
FIG. 5 is an isometric view of the lead sorting module in accordance with the present invention.

A lead sorting module 80, as best seen in FIG. 5 and also shown in FIGS. 6 and 7, includes a frame 82 and a tray 84 attached thereto. The tray 84 is of somewhat U-shaped cross section with an open side facing upwardly toward the wire path P, as shown in FIG. 6, and an open end 86 facing outwardly as shown in FIG. 5. The tray 84 includes an angled flange 88 along two edges adjacent the open side to which is attached a thin strip 90 of pliable material such as rubber, plastic, or neoprene. The strip 90 is attached to the flange 88 by a suitable adhesive or may be attached by means of screws or similar fasteners. The frame 82 includes two outwardly formed tabs 91 which are bent at right angles to the ends of the frame 82. These tabs 91 are spot welded to the tray 86 to effect the attachment of the tray to the frame. A deflecting member or door 92 is pivotally attached to the side 94 of the tray 84 by means of a hinge 96 which is attached to the door 92 and side 94 with the screw fasteners 98. A spring 100 is attached to the frame 82 and the door 92 so that it urges the door to pivot clockwise to the position shown in FIG. 6. A bracket 102 having a camming surface 104 is attached to the door 92 by means of the screw fasteners 106 as shown in FIGS. 5, 6 and 7. A linear actuator, in the present example an air cylinder 110, is attached to an outside wall of the tray 84 in alignment with the bracket 102. The air cylinder 110 includes a piston rod 112 with a rounded end which engages the camming surface 104. With no air pressure applied to the air cylinder 110, the piston rod 112 is in the position shown in FIG. 6. This allows the spring 100 to urge the door 92 to pivot clockwise to the position shown. When the air cylinder 110 is pressurized, the piston rod 112 extends, pushing the camming surface 104 upwardly thereby pivoting the door 92 counterclockwise to the position shown in FIG. 7 where it intersects the wire path P. A clear plastic dust cover 114 is attached to the machine 10, by any suitable means, in the position shown in FIGS. 6 and 7. A door stop bracket 116 is secured to the dust cover 114 in a suitable position to limit the counterclockwise pivotal movement of the door 92 as best seen in FIG. 7. A flexible member 120 is arranged to form a pocket or first compartment 121 between the door 92 and an upright member 122 of the frame 82. The tray 84 on the opposite side of the door 92 serves as a second compartment 123. The purpose of these two compartments will be set forth below. The flexible member 120 may be of a relatively thin pliable sheet material similar to the strip 90. The flexible member 120 may be attached to the upright member 122 and the door 92 by a suitable adhesive or screw fasteners. A flanged lip 124 is formed along the top edge of the upright member 122 and the flexible member 120 made to extend beyond the lip as shown in FIGS. 6 and 7. This extension as well as the strip 90 serve to accommodate slight misalignment of the lead sorting module 80 within the exit station. The pliable material will abut the adjacent walls of the exit station and, where interference exists will deform slightly.

A crimp quality monitor 130 is located within the electrical cabinet of the machine 10 adjacent the press 18 and is shown in dashed lines since it is below the surface of the top plate 12. The crimp quality monitor 100 is fully described in the '036 patent application referenced above, and therefore, will not be described in detail here. Briefly, the crimp quality monitor 100 has sensors that attach to the terminal applicators of the presses 18 and 20 and collect force and ram position data which is analyzed by a dedicated computer to determine whether an attachment of a terminal onto a wire lead is defective or not. When the attachment is approaching its dimensioned tolerance limits the applicator can be automatically adjusted to bring the dimension back closer to the norm. Additionally, the crimp quality monitor will generate a reject signal if the attachment is deemed to be out of tolerance and the lead unusable.

In the present invention, such a reject signal is used to cause the cylinder 110 to pivot the door 92 to the position shown in FIG. 7 so that the door blocks the wire path P. In this case, the defective wire lead 30 is dropped onto the door 92 and is deflected onto the flexible member 120 in the first compartment. In the case where the attachment is not defective, the computer signals the cylinder 110 to retract thereby allowing the spring 100 to cause the door 92 to pivot to its position clear of the wire path as shown in FIG. 6. In this case the lead 30 removed from the gripper jaws 56 drops into the second compartment or tray 84. Thus, the crimp quality monitor 100, door 92, and cylinder 110 effectively sort leads having defective terminal attachments from those leads that are not defective.

An important advantage of the present invention is that leads having defective terminal attachments are automatically identified and removed immediately after the defective lead is fabricated and before the next lead is made. This is done without the need for an additional machine cycle thereby not adversely affecting machine speed. Since the defective lead is never allowed to be commingled with high quality leads, there is little chance that a defective lead will inadvertently be included in an end product. Additionally, reliability of the manufacturing operation is enhanced because the subjective element associated with operator evaluation is completely eliminated.

We claim:

1. In an automated machine for making electrical leads having means for cutting a lead of desired length from a supply of wire and for preparing the ends of said lead, terminating means for attaching a terminal to an end of said lead, and monitor means for determining the quality of attachment of said terminal to said end of said lead and to identify a defective attachment, lead transport means having a gripper for gripping said lead at a pick-up station and moving said lead to an exit station and thereupon ejecting said lead along a path within said exit station, a lead sorting module disposed within said exit station comprising:

(1) a first compartment and a second compartment;

(2) a deflecting member movable to a first position where it intersects said path and a second position away from said first position;

(3) actuator means responsive to said monitor means for moving said deflecting member to one of said first and second positions when a defective attachment is identified so that when said lead is ejected along said path said lead enters into one of said first compartment or said second compartment, wherein said second compartment is a tray and said deflecting member is a relatively thin planar member hingedly attached to said tray, said tray having an opening facing upwardly in vertical alignment with said path so that when said deflecting member is in its second position an ejected lead will fall by gravity into said tray.

2. The apparatus according to claim 1 wherein said deflecting member is arranged so that when in said second position, said ejected lead enters said second compartment.

3. The apparatus according to claim 2 wherein said deflecting member is arranged so that when in said first position said ejected lead is deflected into said first compartment.

4. The apparatus according to claim 3 wherein said first and second compartments are mutually adjacent said deflecting member.

5. The apparatus according to claim 4 wherein said ejecting of said lead by said transport means is effected by said gripper releasing said lead so that said lead falls under the influence of gravity along said path.

6. The apparatus according to claim 1 including dampener means for receiving said lead from said gripper and for dampening movement of said lead prior to said ejecting of said lead along said path.

7. The apparatus according to claim 6 wherein said dampener means comprises:

(a) an abutting surface associated with said transport means;

(b) a latch pivotally attached to said transport means and positioned adjacent said abutting surface to form a channel sized to receive said lead, said latch having a camming surface arranged so that as said lead is moved along from said pick-up station to said exit station, said lead engage said camming surface and causes said latch to pivot allowing said lead to enter said channel.

8. The apparatus according to claim 1 including a frame rigidly attached to said tray having an upright member wherein the space between said upright member and said deflecting member is said first compartment.

9. The apparatus according to claim 8 including a pliable member comprising a relatively thin sheet of material arranged to form a pocket between said upright and deflecting members, one edge being attached to said upright member and another edge being attached to said deflecting member.

10. The apparatus according to claim 3 including a resilient means for urging said deflecting means into said second position.

* * * * *